US008160476B2

(12) United States Patent
Shimizu et al.

(10) Patent No.: US 8,160,476 B2
(45) Date of Patent: Apr. 17, 2012

(54) LATENT IMAGE CARRIER HAVING PAIRS OF FIRST AND SECOND POSITIONING PROTRUSIONS AND IMAGE FORMING APPARATUS

(75) Inventors: Yoshiyuki Shimizu, Osaka (JP); Kenzo Tatsumi, Osaka (JP); Yoshihiro Kawakami, Hyogo (JP); Tomohiro Kubota, Osaka (JP); Koji Kato, Tokyo (JP); Hirobumi Ooyoshi, Tokyo (JP); Tomofumi Yoshida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 860 days.

(21) Appl. No.: 12/042,850

(22) Filed: Mar. 5, 2008

(65) Prior Publication Data

US 2008/0219698 A1 Sep. 11, 2008

(30) Foreign Application Priority Data

Mar. 6, 2007 (JP) ..... 2007-055128

(51) Int. Cl.
*G03G 21/16* (2006.01)

(52) U.S. Cl. ..... 399/111; 399/116; 399/117

(58) Field of Classification Search ..... 399/111, 399/116–117
See application file for complete search history.

(56) References Cited

U.S. PATENT DOCUMENTS

| | | | | |
|---|---|---|---|---|
| D322,279 | S | 12/1991 | Tsutsui | |
| D365,845 | S | 1/1996 | Yasuda et al. | |
| 5,532,795 | A | 7/1996 | Tatsumi et al. | |
| 5,557,382 | A | 9/1996 | Tatsumi et al. | |
| 5,678,125 | A | 10/1997 | Kutsuwada et al. | |
| 5,734,953 | A | 3/1998 | Tatsumi | |
| 5,765,079 | A | 6/1998 | Yoshiki et al. | |
| D398,633 | S | 9/1998 | Hashizume et al. | |
| 5,815,767 | A | 9/1998 | Kutsuwada et al. | |
| 5,828,935 | A | 10/1998 | Tatsumi et al. | |
| 5,887,224 | A | 3/1999 | Mizuishi et al. | |
| 5,915,143 | A | 6/1999 | Watanabe et al. | |
| 5,943,529 | A * | 8/1999 | Miyabe et al. | 399/111 |

(Continued)

FOREIGN PATENT DOCUMENTS

JP 2000-181329 A 6/2000

(Continued)

OTHER PUBLICATIONS

U.S. Appl. No. 29/274,430.

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

There is disclosed an image forming apparatus including: a latent image carrier; a latent image writing unit; a development unit; a latent image carrier unit having the latent image carrier; a first positioning protrusion disposed on the latent image carrier unit, the first positioning protrusion being engaged with a groove or a slit of an image forming apparatus body; an abutted portion disposed on the groove or the slit, the abutted portion abutting the first positioning protrusion in order to position the latent image carrier unit in an installation and removal direction; and a second positioning protrusion shifted in the installation and removal direction and disposed on the latent image carrier unit, the second positioning protrusion positioning the latent image carrier unit at a position different from a position of the first positioning protrusion in order to engage the groove or the slit.

20 Claims, 7 Drawing Sheets

U.S. PATENT DOCUMENTS 6,006,050 A 12/1999 Watanabe et al.
D422,626 S 4/2000 Kurosawa et al.
6,055,388 A 4/2000 Watanabe et al.
6,061,538 A * 5/2000 Arimitsu et al. ..... 399/111
6,085,062 A 7/2000 Mizuishi et al.
6,118,959 A 9/2000 Michlin
6,128,449 A 10/2000 Zenba et al.
6,137,970 A * 10/2000 Sasago ..... 399/106
D433,441 S 11/2000 Yonekawa et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,215,969 B1 * 4/2001 Nomura et al. ..... 399/111
D442,214 S 5/2001 Hayashi
D442,624 S 5/2001 Maeshima
6,246,848 B1 6/2001 Morinaga et al.
6,266,501 B1 7/2001 Mizuishi et al.
D459,388 S 6/2002 Irie et al.
6,463,236 B2 * 10/2002 Morikami et al. ..... 399/121
6,505,020 B1 1/2003 Higeta et al.
6,628,903 B1 9/2003 Ohori et al.
6,665,511 B2 12/2003 Takeuchi et al.
D491,979 S 6/2004 Irie et al.
6,771,918 B2 8/2004 Tatsumi
6,829,462 B2 * 12/2004 Nagashiro ..... 399/258
D501,021 S 1/2005 Saiki et al.
6,898,383 B2 5/2005 Ohori et al.
D506,776 S 6/2005 Kobayashi et al.
6,922,534 B2 * 7/2005 Goto et al. ..... 399/12
7,027,761 B2 4/2006 Koetsuka et al.
D524,849 S 7/2006 Komai
D525,289 S 7/2006 Murata
7,088,940 B2 8/2006 Nakano et al.
7,110,710 B2 9/2006 Yamashita et al.
7,136,608 B2 11/2006 Miller
7,184,691 B2 2/2007 Kita et al.
7,214,461 B2 5/2007 Yamashita et al.
D552,163 S 10/2007 Kouroku et al.
D555,193 S 11/2007 Choi
D580,968 S 11/2008 Tatsumi et al.
D590,011 S 4/2009 Tatsumi et al.
D590,012 S 4/2009 Tatsumi et al.
D597,129 S 7/2009 Tatsumi et al.
D603,450 S 11/2009 Tatsumi et al.
7,890,021 B2 * 2/2011 Yuzawa ..... 399/119
7,940,419 B2 * 5/2011 Tatsumi et al. ..... 358/1.4
7,965,957 B2 * 6/2011 Kubota et al. ..... 399/119
7,965,958 B2 * 6/2011 Tatsumi et al. ..... 399/119
7,991,323 B2 * 8/2011 Hashimoto ..... 399/113
8,000,630 B2 * 8/2011 Matsuda ..... 399/111
8,050,593 B2 * 11/2011 Furuichi et al. ..... 399/112
2003/0108355 A1 * 6/2003 Watanabe et al. ..... 399/12
2003/0219669 A1 11/2003 Yamashita et al.
2006/0024080 A1 2/2006 Chadani et al.
2006/0078810 A1 * 4/2006 Kumano ..... 430/59.6
2006/0268373 A1 11/2006 Tatsumi et al.
2007/0104523 A1 5/2007 Yoshida et al.
2007/0140747 A1 6/2007 Kita et al.
2007/0140763 A1 6/2007 Shimizu et al.
2007/0141492 A1 * 6/2007 Black ..... 430/66
2007/0212119 A1 9/2007 Kurenuma et al.
2007/0248390 A1 10/2007 Kubota et al.
2008/0019720 A1 1/2008 Kawakami et al.
2008/0292356 A1 * 11/2008 Furuichi et al. ..... 399/112
2010/0074646 A1 * 3/2010 Miyahara et al. ..... 399/99
2010/0080624 A1 * 4/2010 Matsuda ..... 399/119
2011/0052255 A1 * 3/2011 Yoshida et al. ..... 399/111
2011/0158681 A1 * 6/2011 Kikuchi et al. ..... 399/111
2011/0206410 A1 * 8/2011 Okabe ..... 399/111

FOREIGN PATENT DOCUMENTS

JP 2002-108173 4/2002
JP 2003-114601 A 4/2003
JP 2003-280313 A 10/2003
JP 2003-307925 A 10/2003
JP 2006-065267 3/2006
JP 2007-17774 A 1/2007

OTHER PUBLICATIONS

U.S. Appl. No. 29/274,433.
Japanese Office Action issued on May 6, 2011 in corresponding Japanese Application No. 2007-055128.
Japanese Office Action for JP Application No. 2011-148071 dated Aug. 31, 2011.

* cited by examiner

LATENT IMAGE CARRIER HAVING PAIRS OF FIRST AND SECOND POSITIONING PROTRUSIONS AND IMAGE FORMING APPARATUS

BACKGROUND OF THE INVENTION

1. Field of the Invention

The present invention relates to a latent image carrier unit including at least a latent image carrier which is removable from a body of an image forming apparatus and the image forming apparatus using the same.

2. Description of the Related Art

Conventionally, there is known an image forming apparatus of this type as disclosed in Patent Document 1. The image forming apparatus includes a photoconductor unit as a latent image carrier unit removable from a body of the image forming apparatus. This photoconductor unit holds a photoconductor as a latent image carrier, a charging roller as a member, and a cleaning member disposed in a peripheral portion of the photoconductor, all enclosed in a common casing as a single unit.

A first positioning protrusion and a second positioning protrusion are disposed on both surfaces of the casing of the photoconductor unit. On the other hand, a first slit in engagement with the first positioning protrusion and a second slit in engagement with the second positioning protrusion are formed on two side plates installed upright in the body of the image forming apparatus to face each other with a predetermined distance. On one side of the photoconductor unit, while the first positioning protrusion of the photoconductor unit is engaged with the first slit on the side plate of a body of the image forming apparatus, the photoconductor unit is inserted in an installation and removal direction of the unit as a longitudinal direction of the first slit to be installed on the body of the image forming apparatus. In this case, when the first positioning protrusion of the photoconductor unit is slidably moved within the first slit and is brought into abutment with an end of the first slit, the photoconductor unit is positioned in the installation and removal direction inside the body of the image forming apparatus.

Further, the second positioning protrusion of the photoconductor unit is engaged with the second slit on the side plate of the body of the image forming apparatus immediately before the positioning. In accordance with this, the photoconductor unit is positioned at a portion different from the first positioning protrusion. Moreover, on the other side of the photoconductor unit, the first positioning protrusion of the photoconductor unit is brought into abutment with an end of the first slit on another side of the body of the image forming apparatus in the same manner. Then, the second positioning protrusion of the photoconductor unit is engaged with the second slit on the other side in the body of the image forming apparatus.

In accordance with such a structure, the photoconductor unit is positioned at the first positioning protrusion and the second positioning protrusion having positions differing from each other on both sides inside the body of the image forming apparatus, so that it is possible to position the entire photoconductor unit and correct posture thereof.

Patent Document 1: Japanese Laid-Open Patent Application No. 2002-108173

However, in such a structure, downsizing of the body of the image forming apparatus becomes difficult due to the following reasons. Specifically, it is desirable that the photoconductor unit have a flat shape when the image forming apparatus is downsized. In particular, in what is called a tandem type color image forming apparatus employing plural photoconductor units each forming a toner image of different color, flattening of each unit is an important factor in downsizing the body of the image forming apparatus because it is possible to have a compact installation space for the photoconductor units by arranging the flat photoconductor units in a thickness direction thereof. In such a layout, each photoconductor unit is designed to slide in the unit thickness direction inside the body of the image forming apparatus in order to be installed or removed from the body of the image forming apparatus. In this structure, even when only a third unit from a front side is desired to be replaced, for example, a first unit and a second unit from the front side must be first pulled out from the body of the image forming apparatus. In accordance with this, a structure allowing each photoconductor unit to be separately installed and removed is employed. On the other hand, the first positioning protrusion and the second positioning protrusion formed on both sides of the photoconductor unit are required to have a certain size because of the necessity for maintaining a desired positioning accuracy and for providing strength capable of withstanding an impact upon installation of the photoconductor unit. In order to engage the relatively large first positioning protrusion and the second positioning protrusion with separate slits on both sides of the photoconductor unit slidably moving in a direction substantially orthogonal to the thickness direction of the photoconductor unit, these protrusions must be arranged in the thickness direction on both sides of the photoconductor unit. Thus, reduction of the thickness of the photoconductor unit or flattening of the photoconductor unit is difficult.

SUMMARY OF THE INVENTION

It is a general object of the present invention to provide an improved and useful image forming apparatus in which the above-mentioned problems are eliminated.

A more specific object of the present invention is to provide an image forming apparatus that allows the flattening of the latent image carrier unit in comparison with conventional image forming apparatuses.

According to one aspect of the present invention, an image forming apparatus is provided comprising: a latent image carrier carrying a latent image on a surface thereof; a latent image writing unit drawing the latent image on the surface; a development unit developing the latent image using toner; a latent image carrier unit having at least the latent image carrier and being removable from a body of the image forming apparatus; a first positioning protrusion disposed on the latent image carrier unit, the first positioning protrusion being engaged with a groove or a slit disposed on each of two surfaces of the image forming apparatus body such that the two surfaces face each other; an abutted portion disposed on the groove or the slit, the abutted portion abutting the first positioning protrusion in order to position the latent image carrier unit in an installation and removal direction relative to the image forming apparatus body in the image forming apparatus body when the latent image carrier unit is installed on the image forming apparatus body; and a second positioning protrusion shifted in the installation and removal direction and disposed on the latent image carrier unit, the second positioning protrusion positioning the latent image carrier unit at a position different from a position of the first positioning protrusion and being shifted from the first positioning protrusion in the installation and removal direction in order to be engaged with the groove or the slit engaged with the first positioning protrusion when the latent image carrier unit is installed on the image forming apparatus body.

The image forming apparatus according to the above-mentioned invention preferably includes: the latent image carrier carrying a latent image on a surface thereof; the latent image writing unit drawing the latent image on the surface; the development unit developing the latent image using toner; and the latent image carrier unit having at least the latent image carrier and being removable from a body of the image forming apparatus. When the latent image carrier unit is inserted into the groove or the slit and installed on the image forming apparatus body while the first positioning protrusions disposed on each of two side surfaces of the latent image carrier unit facing each other are engaged with the groove or the slit disposed on two members of the image forming apparatus body facing each other, the first positioning protrusion sliding in the groove or the slit abuts the abutted portion of the groove or the slit. Preferably, in the image forming apparatus where the latent image carrier unit is positioned in the installation and removal direction relative to the image forming apparatus body in the image forming apparatus body when the first positioning protrusion abuts the abutted portion, the above-mentioned latent image carrier unit has the first positioning protrusion and the second positioning protrusion positioning the latent image carrier unit at a position different from a position of the first positioning protrusion shifted from each other and disposed in the installation and removal direction on each of the two side surfaces of a unit casing, the two side surfaces facing each other. Preferably, in each of the two side surfaces of the latent image carrier unit, the second positioning protrusion is shifted from the first positioning protrusion in the installation and removal direction and engaged with the groove or the slit engaged with the first positioning protrusion.

In the image forming apparatus according to the above-mentioned invention, in the latent image carrier unit, an extended protrusion extended in the installation and removal direction may be disposed between the first positioning protrusion and the second positioning protrusion in the two side surfaces of the unit casing for the two surfaces of the image forming apparatus body, and the extended protrusion may be engaged with the same groove or slit together with the first positioning protrusion and the second positioning protrusion.

In the image forming apparatus according to the above-mentioned invention, in the latent image carrier unit, the first positioning protrusion may be formed using a metallic material and the second positioning protrusion may be formed using a resin material.

In the image forming apparatus according to the above-mentioned invention, regarding at least one of two side surfaces of the latent image carrier unit for the two surfaces of the image forming apparatus body, a movement allowing engagement unit may be disposed on each of the latent image carrier unit and the image forming apparatus body separately from a combination of the first positioning protrusion, the second positioning protrusion, and the groove or the slit, the movement allowing engagement units being engaged with each other to allow movement of the latent image carrier unit in the installation and removal direction, and the movement allowing engagement unit of the latent image carrier unit may be engaged with the movement allowing engagement unit of the image forming apparatus body before the first positioning protrusion abuts the abutted portion when the latent image carrier unit is installed on the image forming apparatus body.

In the image forming apparatus according to the above-mentioned invention, regarding each of the two side surfaces of the latent image carrier unit, a combination of the movement allowing engagement units may be disposed on the latent image carrier unit and the image forming apparatus body.

In the image forming apparatus according to the above-mentioned invention, in the latent image carrier unit, an information storage circuit storing predetermined information and an exposed electrode which is exposed while being electrically connected with the information storage circuit may be disposed, in the image forming apparatus body, a contact electrode may be disposed, the contact electrode being brought into contact with the exposed electrode when the latent image carrier unit is positioned where the first positioning protrusion abuts the abutted portion of the image forming apparatus body, and information communication may be performed between a control unit disposed in the image forming apparatus body and the information storage circuit via the exposed electrode and the contact electrode in contact with each other.

In the image forming apparatus according to the above-mentioned invention, in the latent image carrier unit, in at least one of the two side surfaces for the two surfaces of the image forming apparatus body, the movement allowing engagement unit may be disposed in one of two areas defined by a virtual line as a boundary, the virtual line connecting the first positioning protrusion to the second positioning protrusion and the exposed electrode may be disposed on the other area.

In the image forming apparatus according to the above-mentioned invention, in the latent image carrier unit, in an entire area of a surface of a unit casing, a portion of the entire area frictionally sliding on the contact electrode of the image forming apparatus body when the latent image carrier unit is installed on the image forming apparatus body may be subjected to a process to produce low frictional properties.

In the image forming apparatus according to the above-mentioned invention, a plurality of combinations of the exposed electrode and the contact electrode may be disposed on the latent image carrier unit and the image forming apparatus body.

In the image forming apparatus according to the above-mentioned invention, the combinations of the plural exposed electrodes and the plural contact electrodes each corresponding to the exposed electrodes may be separately determined such that the plural exposed electrodes are moved to a contact position for the corresponding contact electrodes without being in contact with non-corresponding contact electrodes when the latent image carrier unit is installed on the image forming apparatus body.

In the image forming apparatus according to the above-mentioned invention, an electrode extended in the installation and removal direction may be used for at least either the exposed electrode or the contact electrode.

In the image forming apparatus according to the above-mentioned invention, the installation and removal direction may be shifted from a vertical direction.

In the image forming apparatus according to the above-mentioned invention, the installation and removal direction may be shifted from the vertical direction in a rotation direction of torque provided to the latent image carrier unit with a contact point between the first positioning protrusion and the abutted portion acting as a fulcrum in accordance with a rotational moment of drive transmitting gears in the latent image carrier unit and the rotational moment of drive transmitting gears in the latent image carrier unit and the image forming apparatus body.

According to another aspect of the present invention, there is provided a latent image carrier unit having at least a latent image carrier and being removable from a body of an image forming apparatus, comprising: a first positioning protrusion capable of being engaged with a groove or a slit disposed on each of two surfaces of the image forming apparatus body facing each other, the first positioning protrusion abutting an abutted portion disposed on the groove or the slit to position the latent image carrier unit in an installation and removal direction relative to the image forming apparatus body in the image forming apparatus body when the latent image carrier unit is installed on the image forming apparatus body; and a second positioning protrusion shifted in the installation and removal direction and positioning the latent image carrier unit at a position different from a position of the first positioning protrusion, the second positioning protrusion being shifted from the first positioning protrusion in the installation and removal direction in order to engage the groove or the slit engaged with the first positioning protrusion when the latent image carrier unit is installed on the image forming apparatus body.

The latent image carrier unit according to the above-mentioned invention preferably includes: the latent image carrier carrying a latent image on a surface thereof; a latent image writing unit drawing the latent image on the surface; a development unit developing the latent image using toner; and the latent image carrier unit having at least the latent image carrier and being removable from a body of the image forming apparatus. When the latent image carrier unit is inserted into the groove or the slit and installed on the image forming apparatus body while the first positioning protrusions disposed on each of two side surfaces of the latent image carrier unit, the two side surfaces facing each other and are engaged with the groove or the slit disposed on two members of the image forming apparatus body facing each other, the first positioning protrusion sliding in the groove or the slit abuts the abutted portion of the groove or the slit. Preferably, in the latent image carrier unit used for an image forming apparatus where the latent image carrier unit is positioned in the installation and removal direction relative to the image forming apparatus body in the image forming apparatus body when the first positioning protrusion abuts the abutted portion, the first positioning protrusion and the second positioning protrusion positioning the latent image carrier unit at a position different from a position of the first positioning protrusion are shifted from each other and disposed in the installation and removal direction on each of the two side surfaces of a unit casing facing each other. Preferably, in each of the two side surfaces of the latent image carrier unit, the second positioning protrusion is shifted from the first positioning protrusion in the installation and removal direction and engaged with the groove or the slit engaged with the first positioning protrusion.

According to the present invention, in each of the two side surfaces of the latent image carrier unit facing each other, the first positioning protrusion and the second positioning protrusion are engaged with the same groove or slit, so that it is possible to have both protrusions engaged with the groove or the slit in accordance with movement of the latent image carrier unit even when both protrusions are disposed at substantially the same positions in the unit thickness direction. In such a structure, the necessity to largely shift and dispose the first positioning protrusion and the second positioning protrusion in the unit thickness direction is eliminated, so that it is possible to flatten the latent image carrier unit in comparison with a conventional latent image carrier unit where both protrusions are largely shifted and disposed in the unit thickness direction and are engaged with different grooves or slits. In addition, although the first positioning protrusion and the second positioning protrusion are engaged with the same groove or slit, the second positioning protrusion is positioned at a position different from a position of the first positioning protrusion in accordance with contact with the inner wall of the groove or the slit. Thus, it is possible to position or correct posture of an entire unit in the same manner as in a case where both protrusions are engaged with different grooves or slits.

Other objects, features and advantage of the present invention will become more apparent from the following detailed description when read in conjunction with the accompanying drawings.

DETAILED DESCRIPTION OF THE PREFERRED EMBODIMENTS

In the following, an embodiment of an electrophotographic printer (hereafter simply referred to as a printer) is described as an image forming apparatus to which the present invention is applied.

Figure 1:
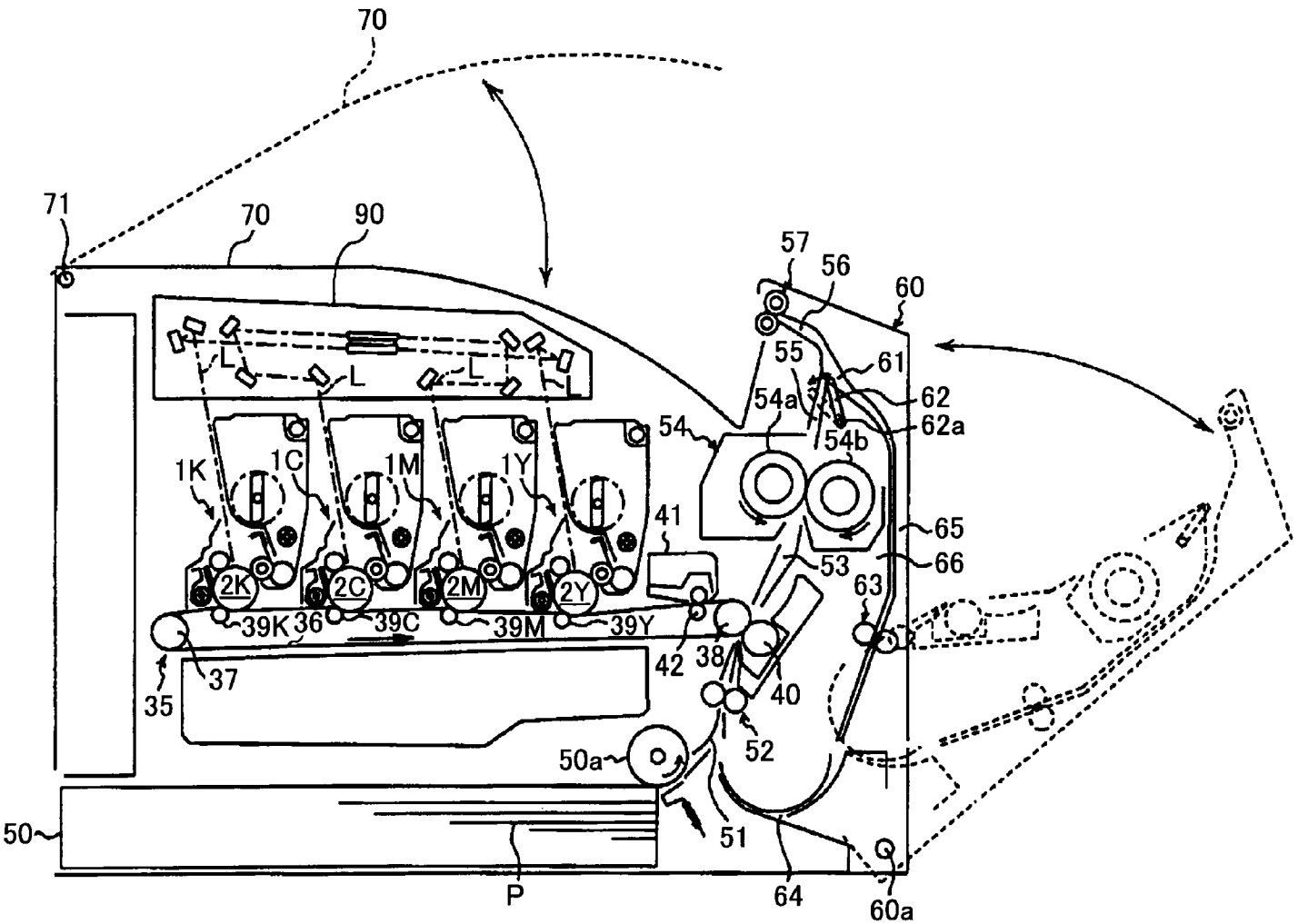
FIG. 1 is a diagram schematically showing a printer according to one embodiment of the present invention.
Figure 2:
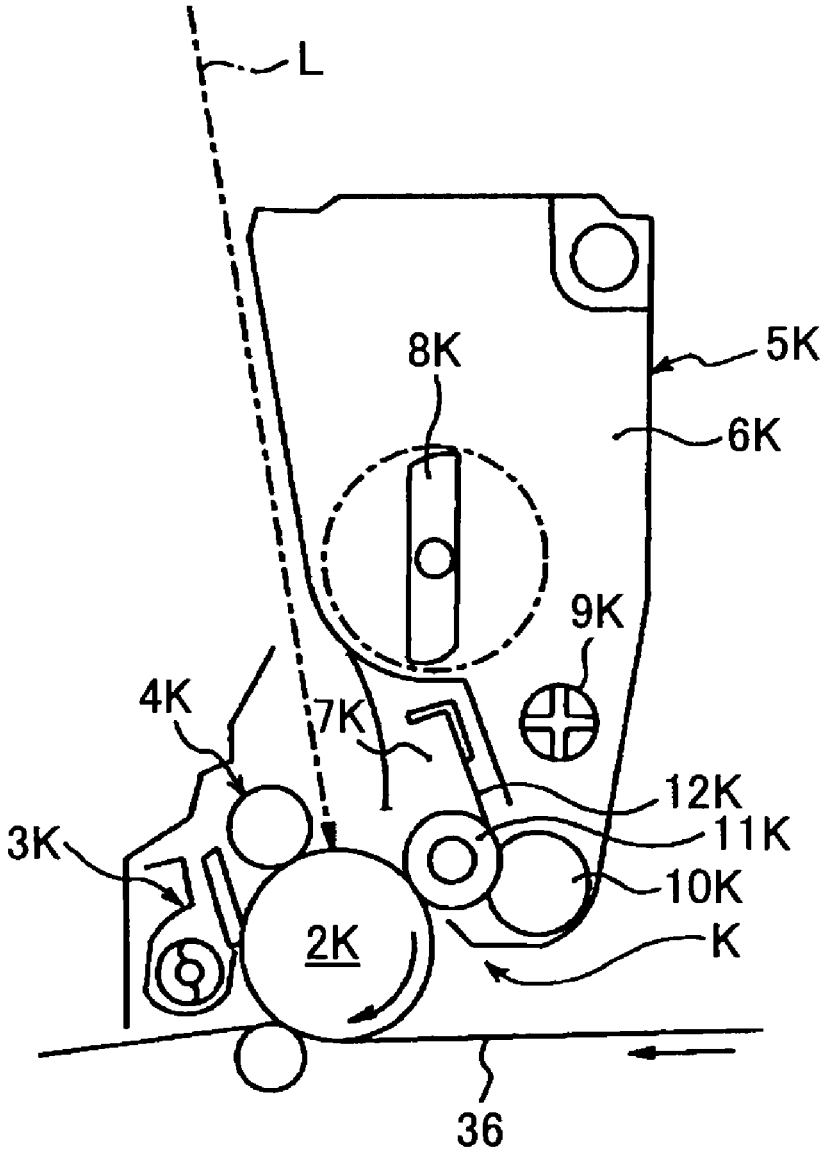
FIG. 2 is an enlarged view showing a K photoconductor unit in a printer.

FIG. 1 is a diagram schematically showing the printer. In FIG. 1, the printer includes four photoconductor units 1Y, 1M, 1C, and 1K for forming toner images of yellow, magenta, cyan, and black (hereafter referred to as Y, M, C, and K). Although the photoconductor units 1Y, 1M, 1C, and 1K use Y, M, C, and K toners having colors each differing from one another, structures thereof are the same and the photoconductor units 1Y, 1M, 1C, and 1K are replaced upon reaching an end of a product life. For example, the photoconductor unit 1K for forming the K toner image includes a drum-shaped photoconductor 2K as the latent image carrier, a drum cleaning device 3K, a static charge eliminator (not shown in the drawings), a charging device 4K, a development device 5K, and the like as shown in FIG. 2. The photoconductor unit 1K is an image forming unit and is removable from a printer body, so that parts that wear out can all be replaced at one time.

The above-mentioned charging device 4K uniformly charges a surface of the photoconductor 2K rotated by a driving unit not shown in the drawings in the clockwise direction in the drawing. The surface of the photoconductor 2K uniformly charged is exposed to a laser light L and scanned in order to carry a latent image for K toner. The latent image for K toner is developed to produce the K toner image by the development device 5K using the K toner. Then, the K toner image is transferred onto an intermediate transfer belt 36 described later. The drum cleaning device 3K removes residual toner attached to the surface of the photoconductor 2K after the intermediate transfer step. The static charge eliminator eliminates residual electric charge from the photoconductor 2K after cleaning. The surface of the photoconductor 2K is initialized from this elimination of static charge and the photoconductor 2K is prepared for a coming image formation. In the photoconductor units (photoconductor units 1Y, 1M, and 1C) of other colors, the Y, M, and C toner images are formed on photoconductors 2Y, 2M, and 2C in the same manner and the toner images are transferred onto the intermediate transfer belt 36.

The development device 5K includes a long hopper unit 6K housing the K toner not shown in the drawings and a development unit 7K. In the hopper unit 6K, there are disposed an agitator 8K rotated by a driving unit not shown in the drawings, a mixing paddle 9K rotated below the agitator 8K in a vertical direction by a driving unit not shown in the drawings, a toner supply roller 10K rotated below the mixing paddle 9K in the vertical direction by a driving unit not shown in the drawings, and the like. The K toner in the hopper unit 6K moves toward the toner supply roller 10K by its own weight while being mixed in accordance with the rotation of the agitator 8K and the mixing paddle 9K. The toner supply roller 10K includes a metallic shaft and a roller unit made of resin foam, for example, coated on a surface thereof. The toner supply roller 10K is rotated while the K toner in the hopper unit 6K is attached to a surface of the roller unit.

In the development unit 7K of the development device 5K, there are disposed a development roller 11K rotated while being in contact with the photoconductor 2K and the toner supply roller 10K, a thin-layered blade 12K whose end edge is in contact with a surface of the development roller 11K, and the like. The K toner attached to the toner supply roller 10K in the hopper unit 6K is supplied to the surface of the development roller 11K at a contact portion between the development roller 11K and the toner supply roller 10K. A layer thickness of the supplied K toner on the roller surface is regulated when the K toner passes through a contact position between the development roller 11K and the thin-layered blade 12K in accordance with the rotation of the development roller 11K. After the layer thickness is regulated, the K toner is attached to an electrostatic latent image for the K toner on the surface of the photoconductor 2K in a development area which is a contact portion between the development roller 11K and the photoconductor 2K. In accordance with the attachment of the K toner, the electrostatic latent image for the K toner is developed to produce the K toner image.

Although the photoconductor unit for K toner is described above with reference to FIG. 2, other photoconductor units 1Y, 1M, and 1C for Y, M, and C toners form the Y, M, and C toner images on surfaces of the photoconductors 2Y, 2M, and 2C in the same process as in the photoconductor unit 1K.

In FIG. 1, an optical writing unit 90 is disposed above the photoconductor units 1Y, 1M, 1C, and 1K in the vertical direction. The optical writing unit 90 functioning as a latent image writing unit performs optical scanning on the photoconductors 2Y, 2M, 2C, and 2K using the laser light L emitted from a laser diode based on image information after the uniform charging in the photoconductor units 1Y, 1M, 1C, and 1K. In accordance with this optical scanning, electrostatic latent images for the Y, M, C, and K toners are formed on the photoconductors 2Y, 2M, 2C, and 2K. The optical writing unit 90 deflects the laser light (L) emitted from the light source in a main scanning direction with a polygon mirror rotated by a polygon motor not shown in the drawings and projects the deflected laser light onto the photoconductor via plural optical lenses and mirrors. The optical writing unit 90 may perform optical writing using an LED light emitted from plural LEDs of an LED array.

A transfer unit 35 is disposed below the photoconductor units 1Y, 1M, 1C, and 1K in the vertical direction. In the transfer unit 35, the endless-shaped intermediate transfer belt 36 is stretched and is caused to perform endless movement in the counterclockwise direction in the drawing. The transfer unit 35 functioning as a transfer unit includes a driving roller 37, a driven roller 38, four primary transfer rollers 39Y, 39M, 39C, and 39K, a secondary transfer roller 40, a belt cleaning device 41, a cleaning backup roller 42, and the like in addition to the intermediate transfer belt 36.

The intermediate transfer belt 36 is stretched by the driving roller 37, the driven roller 38, the cleaning backup roller 42, and the four primary transfer rollers 39Y, 39M, 39C, and 39K disposed inside a loop of the intermediate transfer belt 36. The intermediate transfer belt 36 is caused to perform endless movement in the counterclockwise direction in FIG. 2 in accordance with torque of the driving roller 37 rotated in the same direction by a driving unit not shown in the drawings.

The four primary transfer rollers 39Y, 39M, 39C, and 39K hold the intermediate transfer belt 36 with the photoconductors 2Y, 2M, 2C, and 2K, the intermediate transfer belt 36 being caused to perform endless movement in this manner. Because the intermediate transfer belt 36 is held in this manner, a primary transfer nip for Y, M, C, and K toners is formed in which a front surface of the intermediate transfer belt 36 is in contact with the photoconductors 2Y, 2M, 2C, and 2K.

A primary transfer bias is applied to the primary transfer rollers 39Y, 39M, 39C, and 39K by a bias supply not shown in the drawings. In accordance with this, a primary transfer electric field is formed between the electrostatic latent images on the photoconductors 2Y, 2M, 2C, and 2K and the primary transfer rollers 39Y, 39M, 39C, and 39K. Instead of the primary transfer rollers 39Y, 39M, 39C, and 39K, a transfer charger or transfer brush may be employed.

When the Y toner formed on a surface of the photoconductor 2Y of the photoconductor unit 1Y for Y toner is conveyed to the above-mentioned primary transfer nip for Y toner in accordance with rotation of the photoconductor 2Y, the Y toner is transferred on the intermediate transfer belt 36 from the photoconductor 2Y in a primary transfer through actions of the transfer electric field and nip pressure. In the intermediate transfer belt 36 in which the Y toner image is transferred in the primary transfer in this manner, the M, C, and K toners on the photoconductors 2M, 2C, and 2K are successively superposed on the Y toner image in the primary transfer upon passing through the primary transfer nips for the M, C, and K toners in accordance with the endless movement. In accordance with this primary transfer in which the toner images are superposed, four-color toner images are formed on the intermediate transfer belt 36.

The secondary transfer roller 40 of the transfer unit 35 is disposed outside the loop of the intermediate transfer belt 36 and holds the intermediate transfer belt 36 with the driven roller 38 disposed inside the loop. Because the intermediate transfer belt 36 is held in this manner, a secondary transfer nip is formed in which the front surface of the intermediate transfer belt 36 is in contact with the secondary transfer roller 40. A secondary transfer bias is applied to the secondary transfer roller 40 by a transfer bias supply not shown in the drawings. In accordance with this secondary transfer bias, a secondary transfer electric field is formed between the secondary transfer roller 40 and the driven roller 38 connected to an electrical ground.

A paper feed cassette 50 housing a bundle of plural stacked sheets of recording paper P is slidably and detachably disposed on a casing of the printer below the transfer unit 35 in the vertical direction. In the paper feed cassette 50, a paper feed roller 50*a* is brought into contact with a top of the bundle of recording paper P and the top recording paper P is conveyed toward a paper feed path 51 by rotating the paper feed roller 50*a* in the counterclockwise direction in the drawings at a predetermined time.

In the vicinity of an end of the paper feed path 51, a pair of register rollers 52 is disposed. The pair of the register rollers 52 stops rotation of both rollers upon holding the recording paper P conveyed from the paper feed cassette 50 between the rollers. Then, the pair of the register rollers 52 resumes the rotation at a time allowing the recording paper P held between the rollers to be synchronized with the four-color toner images on the intermediate transfer belt 36 in the above-mentioned secondary transfer nip and convey the recording paper P to the secondary transfer nip.

The four-color toner images transferred on the intermediate transfer belt 36 in the primary transfer and closely attached to the recording paper P in the secondary transfer nip are collectively transferred on the recording paper P in a secondary transfer when the toner images are influenced by the secondary transfer electric field and nip pressure. The transferred toner images become a full-color toner image in combination with white color of the recording paper P. When the recording paper P in which the full-color toner image is formed on the surface thereof in this manner passes through the secondary transfer nip, the recording paper P is separated from the secondary transfer roller 40 and the intermediate transfer belt 36 in accordance with curvature. The separated recording paper P is fed into a fixing device 54 described later via a conveying path 53 after transfer.

The intermediate transfer belt 36 after passing through the secondary transfer nip has residual toner after transfer which is not transferred to the recording paper P. This residual toner is removed from the surface of the intermediate transfer belt 36 by the belt cleaning device 41 in contact with the belt surface. The cleaning backup roller 42 assists the cleaning of the intermediate transfer belt 36 by the belt cleaning device 41 inside the loop.

The fixing device 54 forms a fixing nip using a fuser roller 54*a* internally including a heat source such as a halogen lamp not shown in the drawings and a pressure roller 54*b* rotating while being in contact with the fuser roller 54*a* at a predetermined pressure. The recording paper P fed into the fixing device 54 is held in the fixing nip such that a surface of the recording paper P carrying an unfixed toner image is closely brought into contact with the fuser roller 54*a*. Then, the toner in the toner image is softened in accordance with an influence of heating and pressure, so that the full-color image is fixed.

The recording paper P ejected from the fixing device 54 passes through a conveying path 55 after fixing and then comes to a branch point between a paper ejection path 56 and a conveying path 61 before inversion. A switching claw 62 rotated on a rotation shaft 62*a* is disposed on a side of the conveying path 55 after fixing. The switching claw 62 closes and opens the conveying path 55 after fixing in the vicinity of an end of the conveying path 55 after fixing in accordance with the rotation. At a time when the recording paper P is conveyed from the fixing device 54, the switching claw 62 stops at a rotation position shown in a solid line in the drawing in order to open the conveying path 55 after fixing in the vicinity of the end of the conveying path 55. In accordance with this, the recording paper P is conveyed from the conveying path 55 after fixing to the paper ejection path 56 and is held between rollers of a pair of paper ejection rollers 57.

When a simplex print mode is set from an input operation on an operation unit including a numeric keypad not shown in the drawings or a control signal transmitted from a personal computer not shown in the drawings, the recording paper P held between the pair of the paper ejection rollers 57 is directly ejected from the apparatus. The ejected recording paper P is stacked on a stack unit which is a top surface of a top cover 70 of the casing.

On the other hand, when a duplex print mode is set, after a rear end of the recording paper P passes through the conveying path 55 after fixing, the recording paper P being conveyed in the intermediate transfer belt 36 while a top end thereof is held between the pair of the paper ejection rollers 57, the switching claw 62 rotates to a position shown in a dashed line in the drawing in order to close the conveying path 55 after fixing in the vicinity of the end of the conveying path 55 after fixing. The pair of the paper ejection rollers 57 starts reverse rotation substantially at the same time. Then, the recording paper P is conveyed to the conveying path 61 before inversion while the rear end is positioned at a head of the recording paper P.

FIG. 1 shows the printer from a left side. A front side of a direction orthogonal to the drawing indicates a left side of the printer and a rear side indicates a right side thereof. A right side of the printer in the drawing indicates a front side of the printer and a left side indicates a rear side thereof. A right end of the casing of the printer indicates an inversion unit 60 capable of opening and closing relative to the casing by rotating on a rotation shaft 60*a*.

When the pair of the paper ejection rollers 57 is reversed, the recording paper P is fed into the conveying path 61 before inversion of the inversion unit 60 and is conveyed from an upper side to a lower side in the vertical direction. After the recording paper P is conveyed between rollers of a pair of inversion conveying rollers 63, the recording paper P is fed into an inversion conveying path 64 which is curved to have a semicircular shape. Further, while being inverted by being conveyed along with the curved shape, the recording paper P is conveyed from the lower side to the upper side in the vertical direction such that a conveying direction is reversed from the upper side to the lower side in the vertical direction. Thereafter, the recording paper P passes through the above-mentioned paper feed path 51 and is fed into the secondary transfer nip again. After the four-color toner images are collectively transferred onto the other surface in the secondary transfer, the recording paper P successively passes through the conveying path 53 after transfer, through the fixing device 54, through the conveying path 55 after fixing, through the paper ejection path 56, through the paper ejection rollers 57, and is ejected from the apparatus.

The above-mentioned inversion unit 60 includes an outer cover 65 and a swinging body 66. Specifically, the outer cover 65 of the inversion unit 60 is supported to be rotated on the rotation shaft 60*a* disposed on the casing of the printer. In accordance with the rotation, the outer cover 65 is opened and closed relative to the casing along with the swinging body 66 held inside the outer cover 65. As shown in a dotted line in the drawing, when the outer cover 65 and the swinging body 66 held therein are opened, the paper feed path 51, the secondary transfer nip, the conveying path 53 after transfer, the fixing nip, the conveying path 55 after fixing, and the paper ejection path 56 are vertically divided into two portions and are exposed. In accordance with this, it is possible to readily remove a jammed paper from the paper feed path 51, the secondary transfer nip, the conveying path 53 after transfer, the fixing nip, the conveying path 55 after fixing, and the paper ejection path 56.

Further, the swinging body 66 is supported by the outer cover 65 such that the swinging body 66 rotates on a swinging shaft disposed on the outer cover 65 and not shown in the drawings while the outer cover 65 is opened. In accordance with this rotation, when the swinging body 66 is opened relative to the outer cover 65, the conveying path 61 before inversion and the inversion conveying path 64 are vertically divided into two portions and are exposed. In accordance with this, it is possible to readily remove a jammed paper from the conveying path 61 before inversion and the inversion conveying path 64.

The top cover 70 is supported rotatably on a shaft member 71 as shown by an arrow in FIG. 1. When the top cover 70 rotates in the counterclockwise direction in FIG. 1, the top cover 70 is opened relative to the casing. In accordance with this, an upper opening of the casing is largely exposed.

Figure 3:
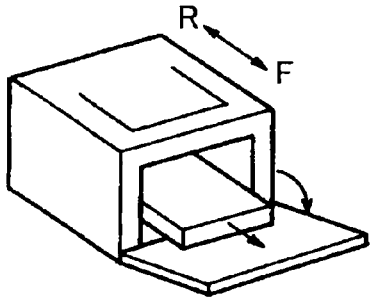
FIG. 3 is a perspective view showing an example of an image forming apparatus for which internal maintenance is performed with a front cover opening type.
Figure 4:
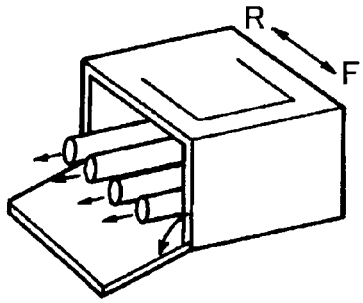
FIG. 4 is a perspective view showing an example of an image forming apparatus for which internal maintenance is performed with a left cover opening type.

In image forming apparatuses of recent years, it is desired that the installation and removal of inner parts and devices are performed without having a negative influence on size reduction, weight reduction, or ease of use of the image forming apparatuses. Examples of installation and removal of parts and devices include a method in which a front cover disposed on a front end of the casing (end in a direction of an arrow F in the drawing) of the image forming apparatus is opened as shown in FIG. 3 and a method in which a left cover disposed on a left end of the casing is opened as shown in FIG. 4.

Figure 5:
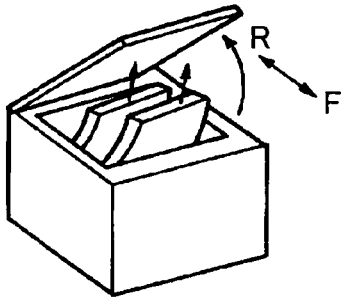
FIG. 5 is a perspective view showing an example of an image forming apparatus for which internal maintenance is performed with a top cover opening type.
Figure 6:
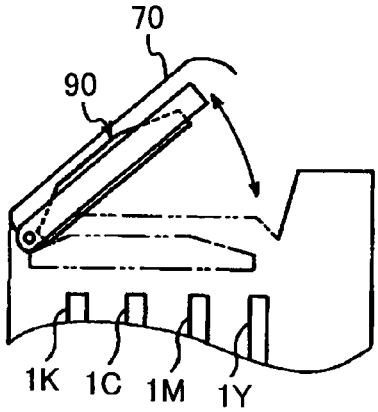
FIG. 6 is a schematic diagram showing an opening and closing operation of a top cover in a printer according to one embodiment of the present invention.

Another example is a method in which a top cover disposed on an upper end of the casing is opened as shown in FIG. 5. Preferably, this method in which the top cover is opened is employed for parts and devices having a relatively high frequency of installation and removal because a user is allowed to reduce any work burden and generation of operation errors by confirming installation and removal operations while viewing the casing from above, without assuming an unstable posture such as crouching, bending over, and the like. Another reason that this method is preferable is that the top portion of the image forming apparatus is often used as a paper ejection tray or a scanner is installed thereon, so that visibility is likely to be improved.

In the printer according to the embodiment shown in FIG. 1, examples of devices having a relatively high frequency of installation and removal includes the above-mentioned four photoconductor units 1Y, 1M, 1C, and 1K shown in FIG. 1. These units are replaced at a time when the toner in the development device is exhausted. When a structure for installing and removing these photoconductor units 1Y, 1M, 1C, and 1K in the top cover opening method, as shown in and described with reference to FIG. 5 is considered, the most important conditions of the layout for each of the photoconductor units 1Y, 1M, 1C, and 1K are to arrange each flat unit widthwise in a thickness direction. If the units are arranged lengthwise rather than widthwise, when a third unit from a top unit is to be replaced, for example, the first and second units, which are not to be replaced, must be removed in addition to the third unit, so that ease of use is substantially reduced.

Accordingly, when the lateral layout is employed for the four photoconductor units 1Y, 1M, 1C, and 1K, the intermediate transfer belt 36 must be stretched widthwise as shown in FIG. 1 such that the intermediate transfer belt 36 is brought into contact with each of the photoconductors 2Y, 2M, 2C, and 2K arranged widthwise. Then, the four photoconductor units 1Y, 1M, 1C, and 1K arranged widthwise must be disposed above the intermediate transfer belt 36 stretched widthwise in the vertical direction as shown in FIG. 1 or the four photoconductor units 1Y, 1M, 1C, and 1K are to be disposed below the intermediate transfer belt 36 as an opposite side of the layout in FIG. 1.

When the four photoconductor units 1Y, 1M, 1C, and 1K are disposed below the intermediate transfer belt 36, the optical writing unit 90 must be disposed widthwise below each of the photoconductor units such that the optical writing unit 90 is capable of performing optical scanning on each of the four photoconductors 2Y, 2M, 2C, and 2K. In contrast to the layout shown in FIG. 1, the optical writing unit 90, each of the photoconductor units 1Y, 1M, 1C, and 1K arranged widthwise, and the intermediate transfer belt 36 are successively overlapped from the lower side to the upper side in the vertical direction. However, in this structure where the recording paper P is conveyed from the lower side to the upper side in the vertical direction, the fixing device 54 must be disposed above the intermediate transfer belt 36 forming the secondary transfer nip. Thus, when the above-mentioned layout is employed, a blank space is formed to the left of the fixing device 54 in the drawing, so that downsizing of the apparatus and saving of space become difficult.

In view of this, in the printer according to the embodiment shown in FIG. 1, the four photoconductor units 1Y, 1M, 1C, and 1K are arranged widthwise and are disposed above the intermediate transfer belt 36 stretched widthwise in the layout as shown in FIG. 1. In such a layout, the optical writing unit having a long shape in a lateral direction is disposed above the four photoconductor units 1Y, 1M, 1C, and 1K as shown in FIG. 1. Then, the four photoconductor units 1Y, 1M, 1C, and 1K and the optical writing unit 90 are disposed in a lateral direction of the fixing device 54, so that the generation of the blank space is prevented.

On the other hand, when each of the photoconductor units arranged widthwise is disposed above or below the intermediate transfer belt 36 stretched widthwise, it is necessary to withdraw the optical writing unit 90 or the intermediate transfer belt 36 from a position facing each of the photoconductor units before installing or removing each of the photoconductor units. For example, when each of the photoconductor units is disposed above the intermediate transfer belt 36 as in the printer shown in FIG. 1, the optical writing unit 90 is disposed above each of the photoconductor units 1Y, 1M, 1C, and 1K. In such a layout, even when the top cover 70 is opened relative to the casing, the optical writing unit 90 hinders exposure of each photoconductor unit immediately below the optical writing unit 90. Accordingly, it is necessary to withdraw the optical writing unit 90 from a position immediately above each of the photoconductor units before installing or removing each of the photoconductor units. Further, in contrast to the structure shown in FIG. 1, when each of the photoconductor units is disposed below the intermediate transfer belt 36, the intermediate transfer belt 36 is positioned immediately above each of the photoconductor units. Accordingly, the intermediate transfer belt 36 is required to be withdrawn from the position immediately above each of the photoconductor units before each of the photoconductor units is installed or removed.

In the printer shown in FIG. 1, as mentioned above, each of the photoconductor units is disposed above the intermediate transfer belt 36 and the optical writing unit 90 is disposed above the photoconductor units, so that the optical writing unit 90 is required to be withdrawn from the position immediately above each of the photoconductor units. Accordingly, in this printer, the optical writing unit 90 is held in a lower surface of the top cover 70 in order to be withdrawn from the position immediately above each of the photoconductor units and to be set in the position in accordance with the opening and closing of the top cover 70.

In the following, a specific structure of the printer is described.

Figure 7:
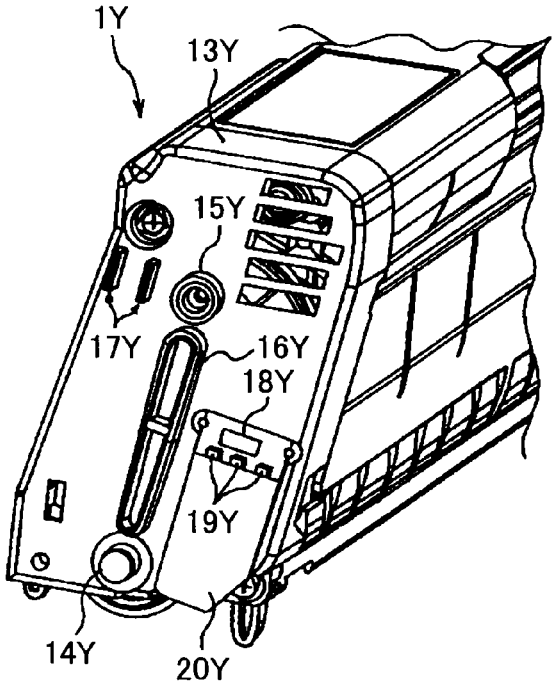
FIG. 7 is a partial perspective view showing a Y photoconductor unit in a printer.

FIG. 7 is a partial perspective view showing the photoconductor unit 1Y for Y toner in the printer. In FIG. 7, the photoconductor unit 1Y is set in the printer body (not shown) such that a direction of an axis line of the photoconductor as a longitudinal direction (not shown) is extended in a horizontal direction. Then, a length of a unit width direction (hereafter referred to as a unit thickness direction) has a flat shape which is substantially small in comparison with a unit length direction and a height direction.

On a surface of a left side case 13Y in the casing of the photoconductor unit 1Y, there are disposed a first positioning protrusion 14Y, a second positioning protrusion 15Y, a protrusion 16Y for slide guiding, and a protrusion 17Y for judging device types such that each protrusion protrudes from the case surface. Further, an IC chip 18Y as an information storage circuit, plural exposed electrodes 19Y, and a protection sheet 20Y, and the like are disposed from the case surface.

The first positioning protrusion 14Y protrudes from a center of the case thickness direction in the vicinity of a lower end of the left side case 13Y and has a cylindrical hollow cap shape. In the left side case 13Y, a photoconductor bearing (not shown) is formed to hold the shaft of the photoconductor in the unit (not shown). The shaft of the photoconductor penetrates the photoconductor bearing disposed in the case and protrudes from the case surface (not shown). The first positioning protrusion 14Y having the cylindrical hollow cap shape covers a portion of a shaft member of the photoconductor protruding from the case surface. In other words, the first positioning protrusion 14Y is formed at the shaft of the photoconductor. When the photoconductor unit 1Y is set in the printer body, the photoconductor unit 1Y is positioned by the first positioning protrusion 14Y at the shaft of the photoconductor.

The second positioning protrusion 15Y protrudes from a center of the case thickness direction in an upper portion of the left side case 13Y. Further, the protrusion 16Y for slide guiding has a rail-like shape extending between the vicinity of the first positioning protrusion 14Y and the vicinity of the second positioning protrusion 15Y in the unit height direction. The protrusion 17Y for judging device types protrudes in the vicinity of a side of the second positioning protrusion 15Y in the unit height direction.

In FIG. 7, only a left end is shown from both ends (left end and right end of the unit) of the photoconductor unit 1Y in the length direction. However, on a right side case disposed on the right end and not shown in FIG. 7, there are disposed a first positioning protrusion, a second positioning protrusion, and a protrusion for slide guiding in the same manner as on the left side case 13Y. Moreover, in the right side case, a protrusion for judging colors (described later) is disposed instead of the protrusion 17Y for judging device types.

The IC chip 18Y fixed on the left side case 13Y stores information specific to each product of the photoconductor unit 1Y such as a unit ID number, unit operating time, date of manufacture, and the like. The plural exposed electrodes 19Y disposed on the left side case 13Y are electrically connected with plural input/output terminals of the IC chip 18Y not shown in the drawings.

Figure 8A:
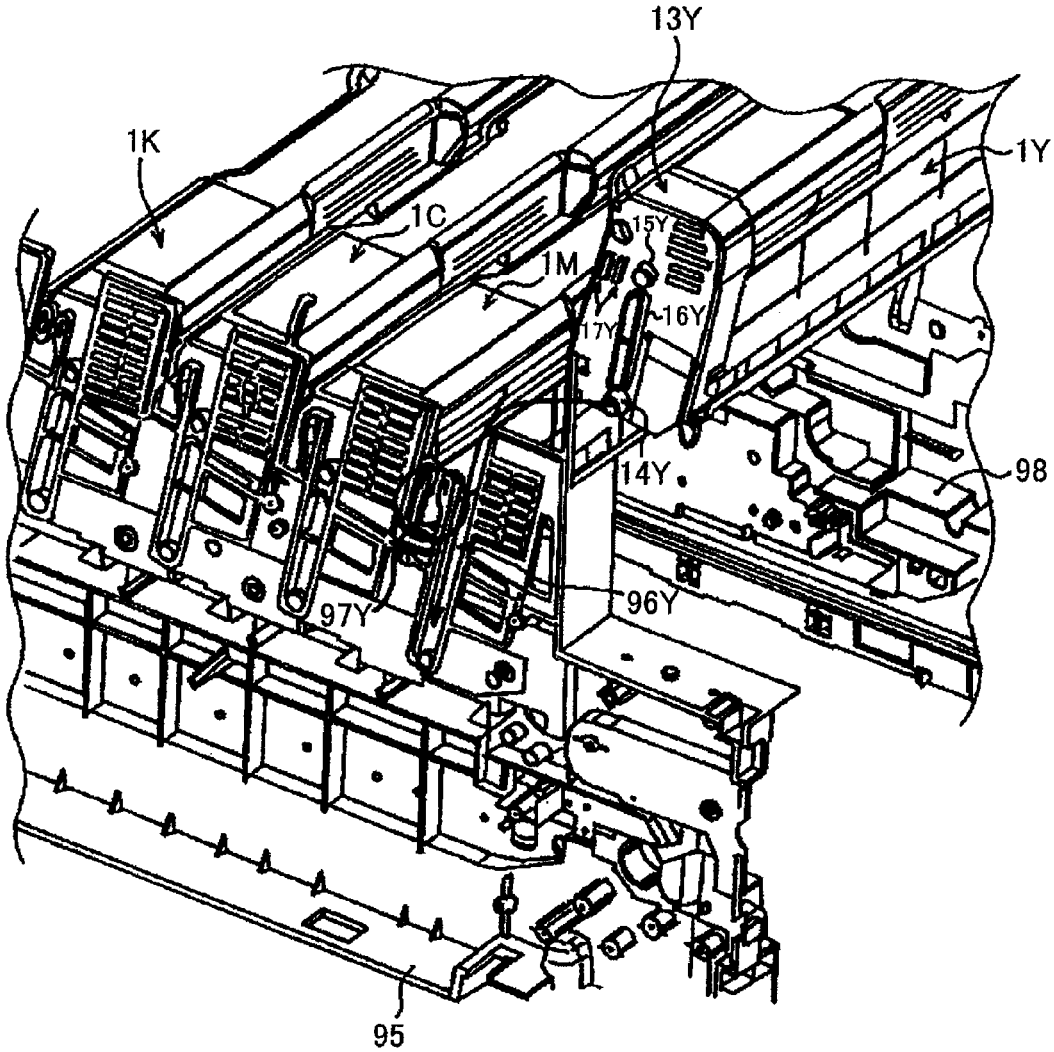
FIG. 8A is a perspective view showing four photoconductor units inside a casing of a printer.

FIG. 8A is a perspective view showing the four photoconductor units 1Y, 1M, 1C, and 1K in the casing of the printer. In FIG. 8A, a left side plate 95 and a right side plate 98 are installed upright as two members in order to face each other at a predetermined distance in left and right directions (photoconductor unit extending direction in FIG. 8A) in the casing of the printer body. The photoconductor units 1Y, 1M, 1C, and 1K are set such that they are installed between both plates while the length direction is in parallel with a direction facing the left side plate 95 and the right side plate 98 as shown in FIG. 8A.

In the left side plate 95, a slit 96Y extending in a direction slightly tilted relative to the vertical direction is set such that an upper end of the left side plate 95 is cut. The slit 96Y is for guiding the photoconductor unit 1Y for Y toner to a setting position thereof. On the left side plate 95, the same slits (reference numerals are omitted) for each of M, C, and K toners are disposed in addition to the slit for Y toner. Moreover, the same slits for Y, M, C, and K toners are disposed on the right side plate 98 but are not shown in FIG. 8A because the slits are hidden by each photoconductor unit.

When the photoconductor unit 1Y for Y toner is installed on the printer body, the photoconductor unit 1Y, held such that the unit length direction is in parallel with the side plate facing direction, is moved from above the printer to the printer body. Then, the first positioning protrusion 14Y formed in the vicinity of the lower end of the left side case 13Y of the photoconductor unit 1Y is inserted into an inlet of the slit 96Y disposed on the left side plate 95 of the printer body. At the same time, the other first positioning protrusion formed in the vicinity of the lower end of the right side case of the photoconductor unit 1Y (not shown) is inserted into an inlet of the slit for Y toner (not shown) and disposed on the right side plate 98 of the printer body.

Then, as the photoconductor unit 1Y is further moved downward while a posture thereof is maintained, the first positioning protrusion 14Y is slid for a unit installation direction from an upper portion to a lower portion inside the slit 96Y. At the same time, the other first positioning protrusion disposed on the right side case of the photoconductor unit 1Y (not shown) is also slid inside the other slit. Then, the protrusion 16Y for slide guiding having the rail-like shape disposed on the left side case 13Y of the photoconductor unit 1Y is immediately inserted into the inlet of the slit 96Y and starts a sliding movement inside the slit 96Y. Further, substantially at the same time, the other protrusion for slide guiding disposed on the right side case (not shown) is inserted into the other slit disposed on the right side plate 98 of the printer body and starts a sliding movement.

As the photoconductor unit 1Y is further moved downward, a rear end of the protrusion 16Y for slide guiding passes through the inlet of the slit 96Y. Further, substantially at the same time, a rear end of the protrusion for slide guiding disposed on the right side case of the photoconductor unit 1Y (not shown) passes through the inlet of the other slit disposed on the right side plate 98 of the printer body. Then, the second positioning protrusion 15Y disposed on the left side case 13Y of the photoconductor unit 1Y is inserted into the inlet of the slit 96Y and starts a sliding movement inside the slit 96Y. Further, substantially at the same time, the other second positioning protrusion disposed on the right side case of the photoconductor unit 1Y (not shown) is inserted into the inlet of the other slit disposed on the right side plate 98 of the printer body and starts a sliding movement inside the slit.

As the photoconductor unit 1Y is further moved downward, the first positioning protrusion 14Y disposed in the vicinity of the lower end of the left side case 13Y abuts a lower end inner wall of the slit 96Y as an abutted portion. Further, substantially at the same time, the other first positioning protrusion disposed in the vicinity of the lower end of the right side case of the photoconductor unit 1Y (not shown) abuts a lower end inner wall (abutted portion) of the other slit disposed on the right side plate 98 of the printer body. Because of the abutment, the photoconductor unit 1Y is positioned in the printer casing in a length direction (unit installation and removal direction) of the slit 96Y (and the other slit). Moreover, in this case, the second positioning protrusion 15Y in the slit 96Y is positioned at a position different from that of the first positioning protrusion 14Y due to the contact with the inner wall of the slit 96Y. In accordance with this, an entire portion of the photoconductor unit 1Y is corrected and posture thereof is corrected.

When the protrusion 16Y for slide guiding is not disposed in position, while the photoconductor unit 1Y is further moved downward after the first positioning protrusion 14Y is inserted into the slit 96Y, the second positioning protrusion 15Y may abut the upper end of the left side plate 95 depending on the posture (angle) of the photoconductor unit 1Y. By contrast, when the protrusion 16Y for slide guiding is disposed in position, the second positioning protrusion 15Y is smoothly guided into the slit 96Y by regulating the posture of downward installation of the photoconductor unit 1Y using the engagement between the protrusion 16Y for slide guiding and the slit 96Y. In accordance with this, it is possible to improve a positioning accuracy of the photoconductor unit 1Y.

In the printer having such a structure, the first positioning protrusion 14Y and the second positioning protrusion 15Y are engaged with the slit 96Y disposed on the left side plate 95 of the printer body, so that it is not necessary to widely shift the first positioning protrusion 14Y and the second positioning protrusion 15Y to be disposed in the unit thickness direction. In accordance with this, it is possible to flatten the photoconductor unit 1Y in comparison with the conventional unit in which the first positioning protrusion 14Y and the second positioning protrusion 15Y are widely shifted to be disposed in the unit thickness direction, and the first positioning protrusion 14Y and the second positioning protrusion 15Y are separately engaged with slits. It is also possible to flatten other photoconductor units 1M, 1C, and 1K, for M, C, and K toners based on the same structure in comparison with the conventional unit.

In the above-mentioned example, the first positioning protrusion 14Y and the second positioning protrusion 15Y are engaged with the slit 96Y. However, the first positioning protrusion 14Y and the second positioning protrusion 15Y may engage a groove extending in the unit installation direction.

In the printer, although the photoconductor units 1Y, 1M, 1C, and 1K are flattened based on the above-mentioned structure, each unit requires a certain thickness. In the printer, a structure of preventing erroneous installation of the unit and obtaining unit individual information is added using this certain thickness. In the following, such a structure is described.

In the left side plate 95, an engagement unit 97Y preventing installation of a different type of unit is disposed in a lateral direction of the inlet of the slit 96Y. When the engagement unit 97Y preventing installation of a different type of unit engages the protrusion 17Y for judging device types disposed on the left side case 13Y of the photoconductor unit 1Y, it is possible to prevent erroneous installation of the photoconductor unit.

Specifically, various types of image forming apparatuses using photoconductor units are available on the market, so that the photoconductor unit for other device types may be erroneously installed on the printer. In particular, preceding devices and succeeding devices from the same manufacturer have a similar size and shape for the photoconductor unit, so that this type of erroneous installation is likely to occur. Further, even if the device types are matched, when photoconductor units for each color are used as in this printer, the photoconductor unit 1K for K toner may be erroneously installed in an installation position of the photoconductor unit 1Y for Y toner, for example.

In view of this, in the printer, the protrusion 17Y for judging device types and a protrusion for judging colors not shown in the drawings are disposed on the photoconductor unit 1Y to prevent erroneous installation. In addition, the engagement unit 97Y preventing installation of a different type unit and an engagement unit preventing installation of a different color unit (not shown) are disposed on the side plates of the printer body.

In the step of installing the photoconductor unit 1Y on the printer body, at the left end in the printer casing, before the first positioning protrusion 14Y disposed on the left side case 13Y of the photoconductor unit 1Y abuts the lower end inner wall of the slit 96Y, the following phenomenon occurs. Specifically, the protrusion 17Y for judging device types disposed on the left side case 13Y of the photoconductor unit 1Y engages the engagement unit 97Y preventing installation of a different type unit disposed on the left side plate 95 of the printer body. Upon installing a photoconductor unit for a printer whose device type is different from that of the present printer, namely, a photoconductor unit for a different device type, a protrusion of the unit abuts the engagement unit 97Y preventing installation of a different type of unit, so that the installation of the unit is prevented. In accordance with this, the installation of the photoconductor unit for different device type is prevented. In the same manner, installation of a photoconductor unit for different device type is prevented using the photoconductor units 1M, 1C, and 1K for M, C, and K toners.

The engagement unit 97Y preventing installation of a different type of unit disposed on the left side plate 95 of the printer body engages the protrusion 17Y for judging device types such that the protrusion 17Y for judging device types in the photoconductor unit 1Y is allowed to move in a length direction of the slit 96Y. Accordingly, it is possible to further move the photoconductor unit 1Y of the appropriate device type downward and to set the photoconductor unit 1Y at a regular setting position even after the engagement unit 97Y preventing installation of a different type of unit as a movement allowing engagement unit starts to be engaged with the protrusion 17Y for judging device types as a movement allowing engagement unit.

In the right side plate 98, an engagement unit preventing installation of a different color unit (not shown) is disposed in a lateral direction of each inlet of the four slits (not shown). One of these engagement units preventing installation of a different color unit is configured to be engaged with only a protrusion for judging colors for Y toner, for example, among protrusions for judging colors for Y, M, C, and K toners (not shown) and disposed on the four photoconductor units 1Y, 1M, 1C, and 1K. Specifically, the four engagement units preventing installation of a different color unit for Y, M, C, and K toners disposed on the right side plate 98 have a shape different from one another. Further, the protrusions for judging colors for Y, M, C, and K toners disposed on the photoconductor units have a shape different from one another. Each of the engagement units preventing installation of a different color unit for Y, M, C, and K toners is engaged with each of the protrusions for judging colors having a corresponding color, respectively.

In the step of installing the photoconductor unit 1Y on the printer body, at the right end in the printer casing, before the first positioning protrusion disposed on the right side case of the photoconductor unit 1Y (not shown) abuts the lower end inner wall of the slit, the following phenomenon occurs. Specifically, the protrusion for judging colors disposed on the right side case of the photoconductor unit 1Y is engaged with the engagement unit preventing installation of a different color unit disposed on the right side plate 98 of the printer body. Upon installing the photoconductor unit 1M, 1C, or 1K for M, C, or K toner, namely, a photoconductor unit for a different color, a protrusion for judging colors disposed on the unit abuts the engagement unit preventing installation of a different color unit, so that the installation of the unit is prevented. In accordance with this, the installation of the photoconductor unit for different color is prevented. In the same manner, installation of a photoconductor unit for a different color is prevented using the photoconductor units 1M, 1C, and 1K for M, C, and K toners.

The engagement unit preventing installation of a different color unit disposed on the right side plate 98 of the printer body is engaged with the protrusion for judging colors such that the protrusion for judging colors disposed on the photoconductor unit 1Y is allowed to move in a length direction of the slit of the right side plate 98. Accordingly, when a photoconductor unit of appropriate color is installed, it is possible to further move the photoconductor unit downward and to set the photoconductor unit at a regular setting position even after the engagement unit preventing installation of a different color unit as a movement allowing engagement unit starts to be engaged with the protrusion for judging colors as a movement allowing engagement unit.

As mentioned above with reference to FIG. 7, on the left side case 13Y of the photoconductor unit 1Y, the IC chip 18Y is fixed as an information storage circuit. Further, the plural exposed electrodes 19Y are exposed and disposed while each electrode is electrically connected with each of the plural input/output terminals of the IC chip 18Y (not shown). On the other hand, on a surface facing the right side plate (numeral 98 in FIG. 8A) in the left side plate (numeral 95 in FIG. 8A) of the printer body, plural contact electrodes (not shown) are disposed. These contact electrodes are separately in contact with the plural exposed electrodes 19Y of the photoconductor unit 1Y when the photoconductor unit 1Y is positioned (at the regular setting position) such that the first positioning protrusion 14Y abuts the lower end inner wall of the slit (numeral 96Y in FIG. 8A). The printer performs information communication between a control unit disposed in the casing of the printer and not shown in the drawings and the IC chip via the plural exposed electrodes 19Y and the plural contact electrodes not shown in the drawings, the exposed electrodes 19Y and the contact electrodes being brought into contact in this manner. Then, the control unit (including CPU, RAM, ROM, and the like) controlling driving of the photoconductor unit of each color, the transfer unit, and the like obtains information such as the unit ID number, unit operating time, date of manufacture, and the like. The obtained information is used to judge whether the photoconductor unit of each color reaches an end of a product life and whether the photoconductor unit is replaced or simply installed or removed.

It is possible to judge installation of a different type of unit and installation of a different color unit based on information stored in the IC chip 18Y without disposing the above-mentioned engagement unit 97Y preventing installation of a different type of unit, the protrusion 17Y for judging device types, the engagement unit preventing installation of a different color unit, or the protrusion for judging colors. However, in this case, it is impossible to perform such a judgment until the photoconductor unit is inserted into the regular setting position to bring the exposed electrodes into contact with the contact electrodes. By contrast, in the printer where the engagement unit 97Y preventing installation of a different type of unit and the like are disposed as a movement allowing engagement unit, an operator is allowed to notice the installation of a different type of unit and the installation of a different color unit before the photoconductor unit is inserted into the regular setting position. Thus, it is possible to eliminate unnecessary operations for the operator and improve maintenance.

In FIG. 7, the rail-like shape protrusion 16Y for slide guiding is designed to be a thick virtual line connecting the first positioning protrusion 14Y to the second positioning protrusion 15Y. In the left side case 13Y of the photoconductor unit 1Y, the protrusion 17Y for judging device types as a movement allowing engagement unit is disposed in one of areas defined by the protrusion 16Y for slide guiding as a boundary. In addition, the plural exposed electrodes 19Y are disposed in the other area due to the following reason. When the protrusion 17Y for judging device types and the plural exposed electrodes 19Y are disposed only in one of the areas defined by the protrusion 16Y for slide guiding as the boundary, a position where the protrusion 16Y for slide guiding is disposed must be shifted to one end side or the other end side in the unit thickness direction in terms of disposition space in comparison with a status shown in the drawing in order to widen a setting space. Accordingly, the first positioning protrusion 14Y and the second positioning protrusion 15Y must necessarily be shifted in the same manner. In other words, both positioning protrusions must be shifted and disposed on the end side in the unit thickness direction. In such a structure, because the photoconductor unit 1Y is supported using the first positioning protrusion 14Y and the second positioning protrusion 15Y disposed on positions of one of the sides, so that balance is lost and trembling in operation is likely to be generated. By contrast, in the printer, the protrusion 17Y for judging device types and the plural exposed electrodes 19Y are separately disposed on both sides defined by the protrusion 16Y for slide guiding as the boundary, so that it is possible to dispose the first positioning protrusion 14Y and the second positioning protrusion 15Y at a substantially central portion in the unit thickness direction. Accordingly, it is possible to support the photoconductor unit 1Y in a balanced manner and prevent the generation of trembling of the photoconductor unit during operation.

In the photoconductor unit 1Y of the printer, as shown in the drawing, the plural exposed electrodes 19Y are arranged in the unit thickness direction substantially orthogonal to an extending direction of the protrusion 16Y for slide guiding (equal to the length direction of the slit 96Y). Further, in the left side plate (numeral 95 in FIG. 8A) of the printer body, the plural contact electrodes (not shown) are arranged in the unit thickness direction due to the following reason. If the plural exposed electrodes 19Y are arranged in the extending direction of the protrusion 16Y for slide guiding and the above-mentioned photoconductor unit is installed on the body of the above-mentioned image forming apparatus, when the plural exposed electrodes are brought into contact with corresponding contact electrodes without being in contact with non-corresponding contact electrodes, the plural contact electrodes (not shown) on the left side plate of the printer body must be arranged in the same extending direction in accordance with the arrangement of the plural exposed electrodes. In such a layout, in the step of installing the photoconductor unit 1Y in the casing of the printer body, while a bottom of the exposed electrode 19Y among the plural exposed electrodes 19Y disposed on the photoconductor unit 1Y is moved to a contact position for the contact electrode positioned at a bottom of the left side plate, the bottom exposed electrode 19Y frictionally slides on all the other contact electrodes, for example. Further, on the left side plate, the contact electrode positioned at a top of the contact electrodes frictionally slides on all the exposed electrodes 19Y although the contact electrode has no necessity of contact. In accordance with this, the abrasion of the contact electrode is increased from a repetition of the installation and removal of the photoconductor unit 1Y, so that contact failure between the exposed electrodes 19Y and the contact electrode is likely to occur. By contrast, in the printer, the plural exposed electrodes 19Y and the plural contact electrodes are arranged in the unit thickness direction, respectively, so that the plural exposed electrodes 19Y are moved to the contact positions for the corresponding contact electrodes without being in contact with non-corresponding contact electrodes. In accordance with this, it is possible to prevent generation of contact failure from abrasion of the contact electrodes.

In the left side case 13Y of the photoconductor unit 1Y, in an entire area of the plane surface, the protection sheet 20Y is fixed on an area (lower area relative to the exposed electrodes 19Y in this example) where the photoconductor unit 1Y frictionally slides on the contact electrodes of the printer body (not shown) in the step of installing the photoconductor unit 1Y on the printer body. The protection sheet 20Y is made of PET (polyethylene terephthalate) having a smaller coefficient of friction than that of a solid surface of the left side case 13Y. In other words, the photoconductor unit 1Y is subjected to a process to produce low frictional properties on the area which frictionally slides on the contact electrodes of the printer body (left side plate 95) in the step of installing the photoconductor unit 1Y on the printer body. In accordance with this, it is possible to prevent a generation of a flaw on the left side case 13Y when the solid surface of the left side case 13Y directly and frictionally slides on the contact electrodes of the printer body.

In the printer, the plural contact electrodes disposed on the left side plate (95) of the printer body employ contact electrodes extending in the length direction of the slit (96Y) on the left side plate due to the following reason. Specifically, in the photoconductor unit 1Y, a drive receiving gear (a photoconductor gear fixed on the shaft of the photoconductor in this example) (not shown) is disposed. A driving gear on the printer body meshes with the drive receiving gear, so that a drive force is transmitted from the printer body to the photoconductor unit. In such a structure, when the photoconductor unit 1Y is inserted into the printer body, if a relationship of rotational postures between the drive receiving gear of the photoconductor unit and the driving gear of the printer body is inappropriate, gear teeth of both gears may abut each other and the photoconductor unit may not be correctly set at the regular setting position (the first positioning protrusion 14Y does not correctly abut the lower end inner wall of the slit 96Y, hereafter referred to as "slight shift of setting position due to abutted gear teeth"). However, even if such a slight shift of setting position is generated, when the driving gear starts rotation and both gears appropriately mesh with each other, the photoconductor unit 1Y moves downward in accordance with weight of the photoconductor unit 1Y and is spontaneously set at the regular setting position. However, until the photoconductor unit 1Y is set at the regular setting position, the exposed electrodes 19Y of the photoconductor unit and the contact electrodes of the left side plate (95) may cause contact failure from positional shift in the length direction of the slit. In view of this, in the printer, the contact electrodes are extended in the length direction of the slit, so that even if the slight shift of setting position due to abutted gear teeth is generated, the exposed electrodes 19Y and the contact electrodes are securely brought into contact with each other. In addition, instead of extending the contact electrodes in the length direction of the slit, the exposed electrodes 19Y may be extended in the length direction of the slit.

Figure 9:
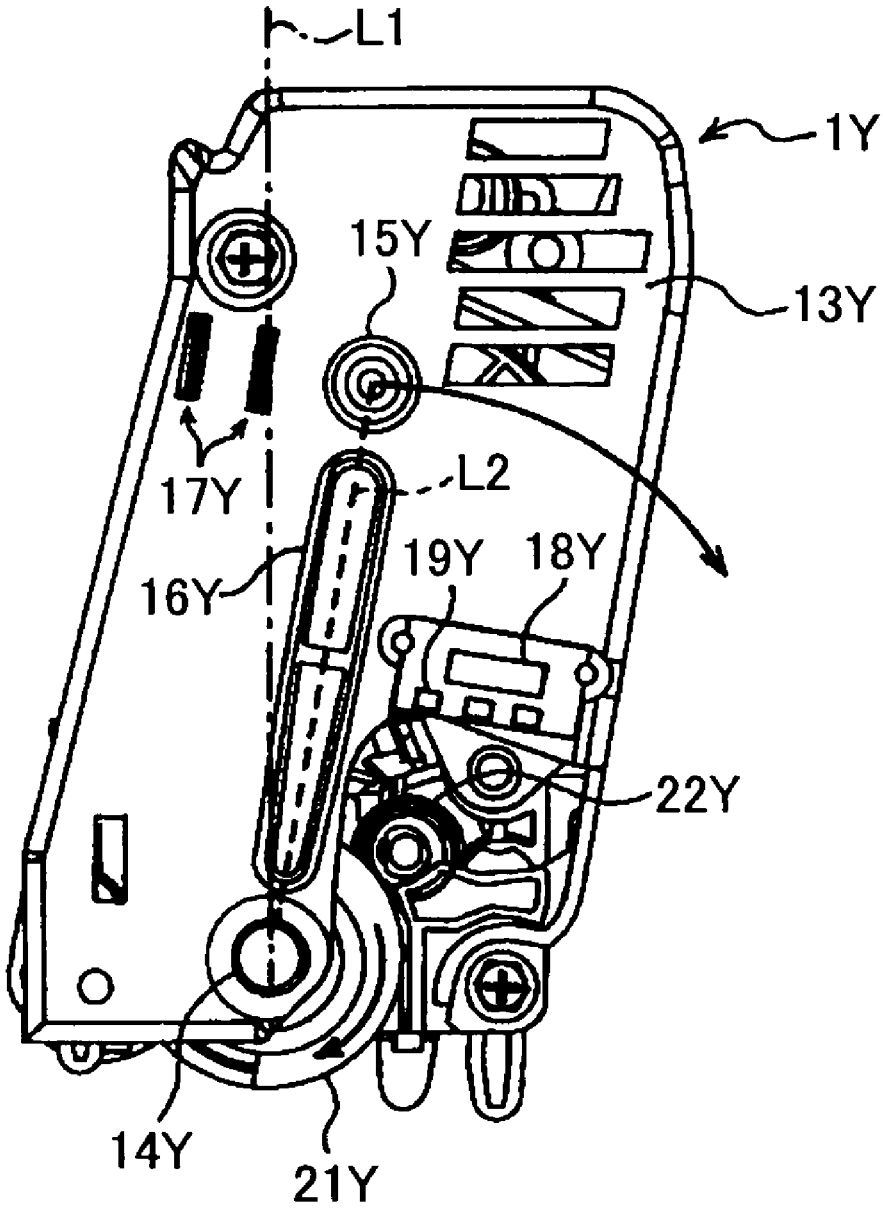
FIG. 9 is a left side elevational view showing a Y photoconductor unit in a printer.

FIG. 9 is a left side elevational view showing a Y photoconductor unit. In FIG. 9, the case area immediately below the IC chip 18Y is sectioned to partially show an inside of the left side case 13Y. In FIG. 9, a virtual line LI extends in the vertical direction. A virtual line L2 connects a center of a cylinder of the first positioning protrusion 14Y and a center of a cylinder of the second positioning protrusion 15Y and an extending direction of the virtual line L2 is along the length direction of the slit (96Y in FIG. 8A) of the left side plate of the printer body (not shown).

In the printer, as indicated by the virtual line L2 in FIG. 9, the length direction of the slit (not shown) is shifted from the vertical direction (extending direction of the virtual line L1) due to the following reason. If the length direction of the slit is along the vertical direction, a total weight of the photoconductor unit 1Y is substantially supported by the first positioning protrusion 14Y as a single-point support, so that a balance of the photoconductor unit 1Y becomes unstable. On the other hand, it is necessary to have a certain clearance between the positioning protrusion and an inner wall of the slit in order to smoothly slide the first positioning protrusion 14Y and the second positioning protrusion 15Y inside the slit. When such a clearance is formed, the photoconductor unit 1Y having the unstable balance due to the single-point support is likely to be shaken in a slit width direction within a range of the clearance. By contrast, as in the printer, if the slit length direction (L2 extending direction) is shifted from the vertical direction (L1 extending direction), the photoconductor unit 1Y is supported by both first positioning protrusion 14Y and second positioning protrusion 15Y as a two-point support, so that it is possible to support the photoconductor unit 1Y in a balanced manner. In accordance with this, it is possible to prevent the trembling of the photoconductor unit 1Y in the slit width direction.

In FIG. 9, a lower end of the first positioning protrusion 14Y is a contact point with the lower end inner wall of the slit (not shown). The photoconductor unit 1Y is provided with a force to rotate on the contact point in the clockwise direction or in the counterclockwise direction in accordance with meshing between a photoconductor gear 21Y and a development roller gear 22Y in the photoconductor unit 1Y or a reaction of meshing between the photoconductor gear 21Y and the driving gear of the printer body (not shown). In the printer, the photoconductor unit 1Y is provided with a force to rotate on the contact point in the clockwise direction, as shown in FIG. 9. In the printer, the virtual line L2 is tilted in the clockwise direction in the drawing relative to the virtual line L1 due to the following reason. When the virtual line L2 is tilted in the same direction as a rotation direction resulting from the meshing of the gears, of two inner walls of the slit facing each other in the width direction within the slit (96Y in FIG. 8A) (not shown), the second positioning protrusion 15Y of the photoconductor unit 1Y is supported while being in contact with one of the inner walls of the slit positioned in the rotation direction. Accordingly, when the photoconductor unit 1Y is provided with the force to rotate in the rotation direction, the second positioning protrusion 15Y is received on the inner wall of the slit positioned in the rotation direction while the force is maintained without trembling toward the opposite inner wall of the slit within the slit. In accordance with this, it is possible to prevent the trembling of the photoconductor unit 1Y resulting from the reaction of meshing between the gears.

In the above-mentioned example of the photoconductor unit 1Y, the drum cleaning device 3K, static charge eliminator (not shown in FIG. 9), charging device 4K, and development device 5K, are held in a unit casing along with the photoconductor 2Y as members disposed in a circumference of the photoconductor 2Y. However, only one to three of these members may be held in the unit casing. Further, it is possible to employ the photoconductor unit 1Y in which members different from the above-mentioned members are held in the unit casing along with the photoconductor 2Y.

As mentioned above, in the photoconductor unit 1Y of the printer, the protrusion 16Y for slide guiding extending in the length direction of the slit 96Y as an extended protrusion is disposed between the first positioning protrusion 14Y and the second positioning protrusion 15Y and the protrusion 16Y for slide guiding is configured to engage the same slit 96Y along with the first positioning protrusion 14Y and the second positioning protrusion 15Y. In such a structure, by smoothly guiding the second positioning protrusion 15Y to the inlet of the slit 96Y using a sliding movement of the protrusion 16Y for slide guiding within the slit 96Y, it is possible to improve a positioning accuracy of the photoconductor unit 1Y.

Further, in the photoconductor unit 1Y of the printer, the first positioning protrusion 14Y is formed using a metallic material and the second positioning protrusion 15Y is formed using a resin material due to the following reason. The first positioning protrusion 14Y is intended to take on a role of blocking the downward movement when the first positioning protrusion 14Y abuts the lower end inner wall of the slit while the photoconductor unit 1Y is inserted into the printer body, so that the first positioning protrusion 14Y receives a substantial impact. Unless the first positioning protrusion 14Y has rigidity capable of resisting this impact, it is impossible to obtain a desired positioning accuracy due to deformation or destruction of the protrusion upon receiving the impact. In view of this, the first positioning protrusion 14Y is formed using a metallic material with high rigidity. On the other hand, the second positioning protrusion 15Y does not receive such an impact, so that the second positioning protrusion 15Y is formed using the same resin material as used for the unit casing in order to simplify a manufacturing step by integrally forming the second positioning protrusion 15Y with the unit casing.

Figure 8B:
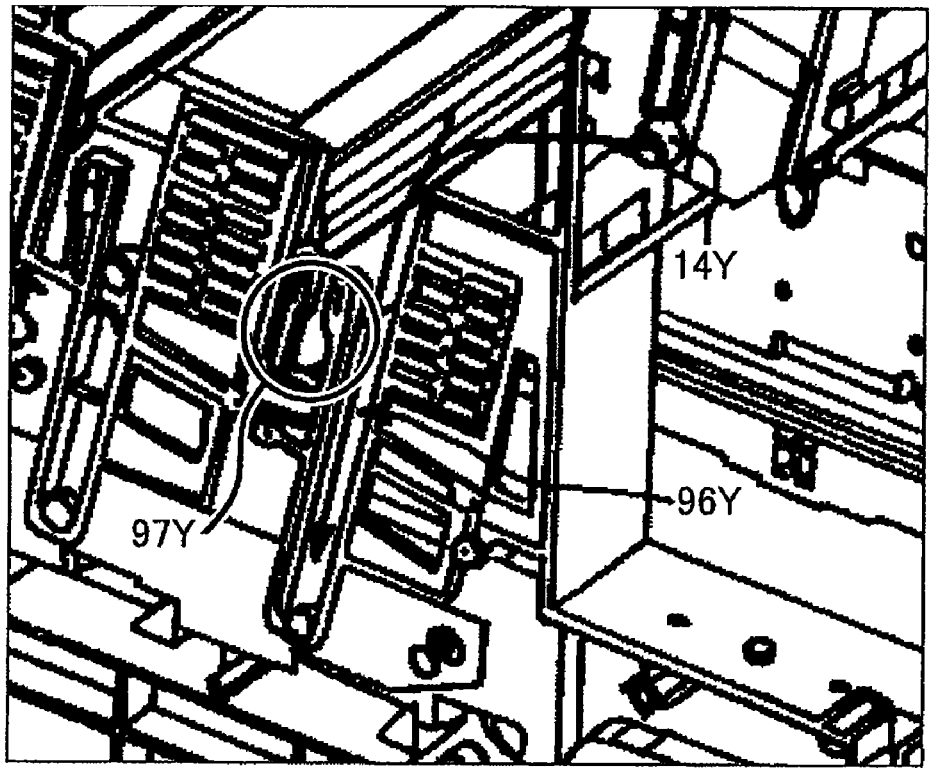
FIG. 8B is an enlargement of a portion of FIG. 8A.

Further, in the printer, in addition to the combination of the first positioning protrusion 14Y, the second positioning protrusion 15Y, and the slit 96Y, the movement allowing engagement units are disposed on the photoconductor unit 1Y and the printer body such that each movement allowing engagement unit is engaged in order to allow the movement of the photoconductor unit 1Y in the length direction of the slit. Specifically, the protrusion 17Y for judging device types and the protrusion for judging colors are disposed on the photoconductor unit 1Y as the movement allowing engagement units. The engagement unit 97Y, a close-up of which is shown in FIG. 8B, preventing installation of a different type unit and the engagement unit preventing installation of a different color unit are disposed on the side plates of the printer body as the movement allowing engagement units to be engaged with the protrusion 17Y for judging device types and the protrusion for judging colors, respectively. In the step of installing the photoconductor unit 1Y on the printer body, before the first positioning protrusion 14Y abuts the lower end inner wall of the slit as the abutted portion, the protrusion 17Y for judging device types and the protrusion for judging colors on the photoconductor unit 1Y engage the engagement unit 97Y preventing installation of a different type unit and the engagement unit preventing installation of a different color unit on the side plates of the printer body. In such a structure, as mentioned above, it is possible to prevent erroneous installation of a photoconductor unit for a different device type and installation of a photoconductor unit for a different color.

Further, in the printer, many combinations of the movement allowing engagement units are disposed on the photoconductor unit 1Y and the side plates of the printer body, so that it is possible to prevent erroneous installation of a photoconductor unit for a different device type and installation of a photoconductor unit for a different color.

Further, in the printer, the photoconductor unit 1Y includes the IC chip 18Y as the information storage circuit storing predetermined information such as the unit ID number, unit operating time, date of manufacture, and the like, and the exposed electrodes 19Y which are exposed and disposed while each electrode is electrically connected with the IC chip 18Y. The printer body includes the contact electrodes brought into contact with the exposed electrodes 19Y when the photoconductor unit 1Y is positioned in the printer body such that the first positioning protrusion 14Y abuts the lower end inner wall of the slit as the abutted portion of the printer body. The information communication is performed between the control unit disposed in the printer body and the IC chip 18Y via the exposed electrodes 19Y and the contact electrodes in contact with each other. In such a structure, as mentioned above, information specific to each unit product such as the unit ID number, unit operating time, date of manufacture, and the like is read from the chip or written in the chip. In accordance with this, it is possible to cause the controller unit to judge whether the photoconductor unit of each color reaches an end of a product life and whether the photoconductor unit is replaced or simply installed or removed, for example.

Further, in the photoconductor unit 1Y of the printer, the protrusion 17Y for judging device types is disposed in one of the areas defined by the virtual line as the boundary, the virtual line connecting the first positioning protrusion 14Y to the second positioning protrusion 15Y. The exposed electrodes 19Y are disposed on one of the other areas. In such a structure, the first positioning protrusion 14Y and the second positioning protrusion 15Y are disposed at the substantially central portion in the unit thickness direction, so that the photoconductor unit 1Y is supported in a balanced manner. Thus, it is possible to prevent generation of trembling of the unit during operation.

Further, in the photoconductor unit 1Y of the printer, in the entire area of the surface of the left side case 13Y which is a casing surface, the area which frictionally slides on the contact electrodes of the printer body in the step of installing the photoconductor unit 1Y on the printer body is subjected to a process to produce low frictional properties. In such a structure, it is possible to prevent generation of a flaw on the left side case 13Y when the solid surface of the left side case 13Y directly and frictionally slides on the contact electrodes of the printer body.

In the printer, the combination of the plurality of exposed electrodes 19Y and the plurality of contact electrodes, each corresponding to the exposed electrodes 19Y, respectively, are determined such that the plural exposed electrodes 19Y are moved to the contact positions for the corresponding contact electrodes without being in contact with non-corresponding contact electrodes in the step of installing the photoconductor unit 1Y on the printer body. In such a structure, it is possible to prevent generation of contact failure of both electrodes resulting from abrasion when the contact electrodes frictionally slide on the exposed electrodes 19Y unnecessarily.

Further, the printer employs electrodes extended in the slit length direction for at least either the exposed electrodes 19Y or the contact electrodes. In such a structure, even if the slight shift of setting position due to abutted gear teeth is generated, the exposed electrodes 19Y and the contact electrodes are securely brought into contact with each other in this status, so that it is possible to read information stored in the IC chip 18Y.

Further, in the printer, the slit length direction is shifted from the vertical direction. In such a structure, the photoconductor unit 1Y is supported by both first positioning protrusion 14Y and second positioning protrusion 15Y as a two-point support, so that it is possible to support the photoconductor unit 1Y in a balanced manner. Thus, it is possible to prevent the trembling of the photoconductor unit 1Y in the slit width direction.

Further, in the printer, taking into consideration the rotational moment of the drive transmitting gears (the photoconductor gear 21Y and the development roller gear 22Y) in the photoconductor unit 1Y and the rotational moment of the drive transmitting gears in the photoconductor unit 1Y and the printer body, the slit length direction is shifted from the vertical direction to the rotation direction of torque provided to the photoconductor unit 1Y with the contact point between the first positioning protrusion 14Y and the lower end inner wall of the slit as a fulcrum. In such a structure, it is possible to receive the rotational moment on the inner wall of the slit positioned in the rotation direction while the rotational moment is maintained without trembling the second positioning protrusion 15Y in the slit 96Y. Thus, it is possible to prevent the trembling of the photoconductor unit 1Y resulting from the reaction of meshing between the gears.

The present invention is not limited to the specifically disclosed embodiment, and variations and modifications may be made without departing from the scope of the present invention.

The present application is based on Japanese priority application No. 2007-055128 filed Mar. 6, 2007, the entire contents of which are hereby incorporated herein by reference.

What is claimed is:

1. An image forming apparatus comprising:

a latent image carrier carrying a latent image on a surface thereof;

a latent image writing unit drawing the latent image on the surface;

a development unit developing the latent image using toner;

a latent image carrier unit having at least the latent image carrier and being removable from a body of the image forming apparatus;

a pair of first positioning protrusions, being cylindrically shaped and disposed on the latent image carrier unit, each first positioning protrusion being engaged with a groove or a slit disposed on each of two surfaces of the image forming apparatus body facing each other;

an abutted portion disposed on the groove or the slit, the abutted portion abutting the respective first positioning protrusion to position the latent image carrier unit in an installation and removal direction relative to the image forming apparatus body in the image forming apparatus body when the latent image carrier unit is installed on the image forming apparatus body; and a pair of second positioning protrusions, shifted in the installation and removal direction and disposed on the latent image carrier unit, each second positioning protrusion disposed above a respective first positioning protrusion in a vertical direction, positioning the latent image carrier unit at a position different from a position of the respective first positioning protrusion and being shifted from the respective first positioning protrusion in the installation and removal direction in order to engage the respective groove or the respective slit engaged with the respective first positioning protrusion when the latent image carrier unit is installed on the image forming apparatus body, wherein each second positioning protrusion is shifted away from the respective first positioning protrusion by an acute angle defined by a y-axis and a line having a slope greater than one.

2. The image forming apparatus according to claim 1, wherein in the latent image carrier unit, an extended protrusion extended in the installation and removal direction is disposed between the first positioning protrusion and the second positioning protrusion in each of two side surfaces of a unit casing corresponding to the two surfaces of the image forming apparatus body, and each extended protrusion engages the same groove or slit together with the respective first positioning protrusion and the respective second positioning protrusion.

3. The image forming apparatus according to claim 1, wherein in the latent image carrier unit, the first positioning protrusions are formed using a metallic material and the second positioning protrusions are formed using a resin material.

4. The image forming apparatus according to claim 1, wherein regarding at least one of two side surfaces of the latent image carrier unit corresponding to the two surfaces of the image forming apparatus body, a movement allowing engagement unit is disposed on each of the latent image carrier unit and the image forming apparatus body separately from a combination of the first positioning protrusion, the second positioning protrusion, and the groove or the slit, the movement allowing engagement units engaging each other in order to allow movement of the latent image carrier unit in the installation and removal direction, and the movement allowing engagement unit of the latent image carrier unit engages the movement allowing engagement unit of the image forming apparatus body before the first positioning protrusion abuts the abutted portion when the latent image carrier unit is installed on the image forming apparatus body.

5. The image forming apparatus according to claim 4, wherein regarding each of the two side surfaces of the latent image carrier unit, a combination of the movement allowing engagement units is disposed on the latent image carrier unit and the image forming apparatus body.

6. The image forming apparatus according to claim 4, wherein in the latent image carrier unit, an information storage circuit storing predetermined information and an exposed electrode exposed while being electrically connected with the information storage circuit are disposed, in the image forming apparatus body, a contact electrode is disposed, the contact electrode being brought into contact with the exposed electrode when the latent image carrier unit is positioned where the first positioning protrusion abuts the abutted portion of the image forming apparatus body, and information communication is performed between a control unit disposed in the image forming apparatus body and the information storage circuit via the exposed electrode and the contact electrode being in contact with each other.

7. The image forming apparatus according to claim 6, wherein in the latent image carrier unit, in at least one of the two side surfaces corresponding to the two surfaces of the image forming apparatus body, the movement allowing engagement unit is disposed in one of two areas defined by a virtual line as a boundary, the virtual line connecting the first positioning protrusion to the second positioning protrusion, and the exposed electrode is disposed on the other area.

8. The image forming apparatus according to claim 6, wherein in the latent image carrier unit, in an entire area of a surface of a unit casing, a portion of the entire area frictionally sliding on the contact electrode of the image forming apparatus body when the latent image carrier unit is installed on the image forming apparatus body is subjected to a process to produce low frictional properties.

9. The image forming apparatus according to claim 6, wherein a plurality of combinations of the exposed electrode and the contact electrode is disposed on the latent image carrier unit and the image forming apparatus body.

10. The image forming apparatus according to claim 9, wherein the combinations of the plural exposed electrodes and the plural contact electrodes each corresponding to the exposed electrodes separately are determined such that the plural exposed electrodes are moved to a contact position for the corresponding contact electrodes without being in contact with non-corresponding contact electrodes when the latent image carrier unit is installed on the image forming apparatus body.

11. The image forming apparatus according to claim 6, wherein an electrode extended in the installation and removal direction is used for at least either the exposed electrode or the contact electrode.

12. The image forming apparatus according to claim 1, wherein in the latent image carrier unit, an information storage circuit storing predetermined information and an exposed electrode exposed while being electrically connected with the information storage circuit are disposed, in the image forming apparatus body, a contact electrode is disposed, the contact electrode being brought into contact with the exposed electrode when the latent image carrier unit is positioned where the first positioning protrusion abuts the abutted portion of the image forming apparatus body, and information communication is performed between a control unit disposed in the image forming apparatus body and the information storage circuit via the exposed electrode and the contact electrode being in contact with each other.

13. The image forming apparatus according to claim 12, wherein in the latent image carrier unit, in an entire area of a surface of a unit casing, a portion of the entire area frictionally sliding on the contact electrode of the image forming apparatus body when the latent image carrier unit is installed on the image forming apparatus body is subjected to a process to produce low frictional properties.

14. The image forming apparatus according to claim 12, wherein a plurality of combinations of the exposed electrode and the contact electrode is disposed on the latent image carrier unit and the image forming apparatus body.

15. The image forming apparatus according to claim 14, wherein the combinations of the plural exposed electrodes and the plural contact electrodes each corresponding to the exposed electrodes separately are determined such that the plural exposed electrodes are moved to a contact position for the corresponding contact electrodes without being in contact with non-corresponding contact electrodes when the latent image carrier unit is installed on the image forming apparatus body.

16. The image forming apparatus according to claim 12, wherein an electrode extended in the installation and removal direction is used for at least either the exposed electrode or the contact electrode.

17. The image forming apparatus according to claim 1, wherein the installation and removal direction is shifted from a vertical direction.

18. The image forming apparatus according to claim 17, wherein the installation and removal direction is shifted from the vertical direction in a rotation direction of torque provided to the latent image carrier unit with a contact point between the first positioning protrusion and the abutted portion acting as a fulcrum in accordance with a rotational moment of drive transmitting gears in the latent image carrier unit and the rotational moment of drive transmitting gears in the latent image carrier unit and the image forming apparatus body.

19. A latent image carrier unit having at least a latent image carrier and being removable from a body of an image forming apparatus, comprising:

a pair of first positioning protrusions being cylindrically shaped and each capable of being engaged with a groove or a slit disposed on each of two surfaces of the image forming apparatus body, the two surfaces facing each other, each first positioning protrusion abutting an abutted portion disposed on the respective groove or the respective slit to position the latent image carrier unit in an installation and removal direction relative to the image forming apparatus body in the image forming apparatus body when the latent image carrier unit is installed on the image forming apparatus body; and a pair of second positioning protrusions, each shifted in the installation and removal direction, disposed above a respective first positioning protrusion in a vertical direction and positioning the latent image carrier unit at a position different from a position of the respective first positioning protrusion, the second positioning protrusion being shifted from the first positioning protrusion in the installation and removal direction in order to be engaged with the groove or the slit engaged with the first positioning protrusion when the latent image carrier unit is installed on the image forming apparatus body, wherein each second positioning protrusion is shifted away from the respective first positioning protrusion by an acute angle defined by a y-axis and a line having a slope greater than one.

20. A latent image carrier unit having at least a latent image carrier and being removable from a body of an image forming apparatus, comprising:

first positioning means for positioning the latent image carrier unit in an installation and removal direction relative to the image forming apparatus body in the image forming apparatus body by abutting an abutted portion disposed on a groove or a slit when the latent image carrier unit is installed on the image forming apparatus body, the first positioning means being cylindrically shaped and being capable of being engaged with the groove or the slit disposed on each of two surfaces of the image forming apparatus body facing each other; and second positioning means for positioning the latent image carrier unit at a position different from a position of the first positioning means and disposed above the first positioning means in a vertical direction, the second positioning means being shifted from the first positioning means in the installation and removal direction in order to be engaged with the groove or the slit engaged with the first positioning means when the latent image carrier unit is installed on the image forming apparatus body, wherein each second positioning means is shifted away from the first positioning means by an acute angle defined by a y-axis and a line having a slope greater than one.

* * * * *